US009739093B2

(12) United States Patent
Trinh et al.

(10) Patent No.: US 9,739,093 B2
(45) **Date of Patent: *Aug. 22, 2017**

(54) CUTTING ELEMENTS COMPRISING SENSORS, EARTH-BORING TOOLS HAVING SUCH SENSORS, AND ASSOCIATED METHODS

(71) Applicant: Baker Hughes Incorporated, Houston, TX (US)

(72) Inventors: Tu Tien Trinh, Houston, TX (US); Eric C. Sullivan, Houston, TX (US); Xiaomin C. Cheng, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/865,835

(22) Filed: Sep. 25, 2015

(65) Prior Publication Data

US 2016/0010395 A1 Jan. 14, 2016

Related U.S. Application Data

(63) Continuation of application No. 13/159,138, filed on Jun. 13, 2011, now Pat. No. 9,145,741.

(51) Int. Cl.
*E21B 10/00* (2006.01)
*E21B 47/00* (2012.01)
(Continued)

(52) U.S. Cl.
CPC ..... *E21B 10/00* (2013.01); *E21B 10/43* (2013.01); *E21B 10/567* (2013.01); *E21B 47/00* (2013.01); *Y10T 29/49826* (2015.01)

(58) Field of Classification Search
CPC ..... E21B 2010/561; E21B 2010/564; E21B 10/567; E21B 10/573; E21B 10/43
See application file for complete search history.

(56) References Cited

U.S. PATENT DOCUMENTS 4,346,591 A 8/1982 Evans
4,655,300 A 4/1987 Davis et al.
(Continued)

OTHER PUBLICATIONS

DiGiovanni et al., Apparatuses and Methods for Detecting Performance Data in an Earth-Boring Drilling Tool, U.S. Appl. No. 61/328,782, filed Apr. 28, 2010.
(Continued)

*Primary Examiner* — Michael Wills, III
(74) *Attorney, Agent, or Firm* — TraskBritt

(57) ABSTRACT

A cutting element for an earth-boring tool includes a body having a longitudinal axis, a generally planar volume of hard material carried by the body, and a sensor affixed to the body. The sensor may be configured to sense at least one of stress and strain. An earth-boring tool includes a cutting element disposed at least partially within a pocket of a body. Methods of forming cutting elements comprise securing a generally planar volume of hard material to a body, attaching a sensor to the body, and configuring the sensor. Methods of forming earth-boring tools comprise forming a cutting element and securing the cutting element within a recess in a body of the earth-boring tool. Methods of forming wellbores comprise rotating an earth-boring tool comprising a cutting element and measuring at least one of stress and strain.

20 Claims, 5 Drawing Sheets

(51) Int. Cl.
*E21B 10/43* (2006.01)
*E21B 10/567* (2006.01)

(56) References Cited

U.S. PATENT DOCUMENTS

| | | | |
|---|---|---|---|
| 4,705,122 | A | 11/1987 | Wardley et al. |
| 4,705,123 | A | 11/1987 | Dennis |
| 4,733,915 | A | 3/1988 | Hedlund |
| 4,785,894 | A | 11/1988 | Davis et al. |
| 4,785,895 | A | 11/1988 | Davis et al. |
| 5,386,724 | A | 2/1995 | Das et al. |
| 5,438,860 | A | 8/1995 | Kawai et al. |
| 5,475,309 | A | 12/1995 | Hong et al. |
| 5,720,355 | A | 2/1998 | Lamine et al. |
| 6,150,822 | A | 11/2000 | Hong et al. |
| 6,612,384 | B1 | 9/2003 | Singh et al. |
| 7,066,280 | B2 | 6/2006 | Sullivan et al. |
| 7,168,506 | B2 | 1/2007 | Boucher et al. |
| 7,650,241 | B2 | 1/2010 | Jogi et al. |
| 8,215,384 | B2 | 7/2012 | Trinh et al. |
| 8,695,729 | B2 | 4/2014 | Kumar et al. |
| 8,746,367 | B2 | 6/2014 | DiGiovanni et al. |
| 8,757,291 | B2 | 6/2014 | Kumar et al. |
| 2002/0116022 | A1 | 8/2002 | Lebouitz et al. |
| 2005/0230149 | A1 | 10/2005 | Boucher et al. |
| 2006/0065395 | A1 | 3/2006 | Snell |
| 2007/0272442 | A1 | 11/2007 | Pastusek et al. |
| 2009/0194332 | A1 | 8/2009 | Pastusek et al. |
| 2010/0089645 | A1 | 4/2010 | Trinh et al. |
| 2010/0118657 | A1 | 5/2010 | Trinh et al. |
| 2010/0186560 | A1 | 7/2010 | Tzschentke et al. |
| 2010/0282510 | A1 | 11/2010 | Sullivan et al. |
| 2011/0024192 | A1 | 2/2011 | Pastusek et al. |
| 2011/0253448 | A1 | 10/2011 | Trinh et al. |
| 2011/0266054 | A1* | 11/2011 | Kumar ..... E21B 10/08 175/39 |
| 2011/0266055 | A1* | 11/2011 | DiGiovanni ..... E21B 10/08 175/50 |
| 2011/0266058 | A1* | 11/2011 | Kumar ..... E21B 10/08 175/57 |
| 2012/0132468 | A1 | 5/2012 | Scott et al. |
| 2012/0312599 | A1 | 12/2012 | Trinh et al. |
| 2012/0325564 | A1 | 12/2012 | Vaughn et al. |
| 2013/0068525 | A1 | 3/2013 | DiGiovanni |
| 2013/0270890 | A1 | 10/2013 | Hall |

OTHER PUBLICATIONS

International Search Report for International Application No. PCT/US2012/042126 dated Mar. 20, 2013, 3 pages.

International Written Opinion for International Application No. PCT/US2012/042126 dated Mar. 20, 2013, 5 pages.

International Preliminary Report on Patentability for International Application No. PCT/US2012/042126 dated Dec. 17, 2013, 6 pages.

Examination Report from the Patent Office of the Cooperation Council for the Arab States of the Gulf for Application No. GC 2012-21491 dated Dec. 18, 2014, 8 pages.

* cited by examiner

CUTTING ELEMENTS COMPRISING SENSORS, EARTH-BORING TOOLS HAVING SUCH SENSORS, AND ASSOCIATED METHODS

CROSS-REFERENCE TO RELATED APPLICATION

This application is a continuation of U.S. patent application Ser. No. 13/159,138, filed Jun. 13, 2011, now U.S. Pat. No. 9,145,741, issued Sep. 29, 2015, the disclosure of which is hereby incorporated herein in its entirety by this reference.

FIELD

Embodiments of the present disclosure generally relate to cutting elements that include a table of superabrasive material (e.g., polycrystalline diamond or cubic boron nitride) formed on a substrate, to earth-boring tools including such cutting elements, and to methods of forming and using such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bi-center bits, reamers, underreamers, and mills.

Different types of earth-boring rotary drill bits are known in the art including, for example, fixed-cutter bits (which are often referred to in the art as "drag" bits), roller cone bits (which are often referred to in the art as "rock" bits), diamond-impregnated bits, and hybrid bits (which may include, for example, both fixed cutters and roller cones). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

The cutting elements used in earth-boring tools often include polycrystalline diamond cutters (often referred to as "PDCs"), which are cutting elements that include a polycrystalline diamond (PCD) material. Such polycrystalline diamond-cutting elements may be formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Cutting elements may become worn during use in a drilling operation. Worn cutting elements may be less effective at cutting the subterranean formation. In addition, as cutting elements wear, they become more and more likely to fail. Failure of cutting elements can result in pieces of hard material becoming dislodged from earth-boring tools, the pieces becoming obstacles to further drilling. For example, broken cutting elements may abrade the earth-boring tool as the broken cutting elements pass up the annular space between the outer surface of the drill string and the exposed surface of the formation within the wellbore. Since the cutting elements may be much harder than the subterranean formation, earth-boring tools may not be able to cut through broken pieces of cutting elements. In some cases, the presence of broken cutting elements within a wellbore may force the operator to redrill the wellbore with a different tool or drill around the damaged cutting elements. To prevent breakage of cutting elements and costs associated with such breakage, an operator may remove an earth-boring tool from service well before its useful life is over. Such premature removal costs operators in both time and money if the earth-boring tool could have safely remained in service. It would therefore be beneficial to have a method to determine the amount of useful life remaining in an earth-boring tool without removing the tool from a wellbore.

BRIEF SUMMARY

In some embodiments, the disclosure includes a cutting element for an earth-boring tool comprising an elongated body having a longitudinal axis, a generally planar volume of hard material attached to the elongated body, and a sensor affixed to the elongated body. A line normal to the generally planar volume of hard material may be oriented at an acute angle to the longitudinal axis of the elongated body. The sensor may be configured to sense at least one of stress applied to the elongated body and strain resulting from an applied stress when the cutting element is mounted on an earth-boring tool and used to cut subterranean formation material.

An earth-boring tool may include a body comprising a pocket and a cutting element disposed at least partially within the pocket.

A method of forming a cutting element for an earth-boring tool may include securing a generally planar volume of hard material to an elongated body such that the generally planar volume of hard material is disposed in a plane oriented at an acute angle to a longitudinal axis of the elongated body, attaching a sensor to the elongated body, and configuring the sensor to sense at least one of stress applied to the elongated body and strain resulting from an applied stress when the cutting element is mounted on an earth-boring tool and used to cut subterranean formation material.

A method of forming an earth-boring tool may comprise forming a cutting element and securing the cutting element within a recess in a body of an earth-boring tool. Forming the cutting element may comprise securing a generally planar volume of hard material to an elongated body such that the generally planar volume of hard material is disposed in a plane oriented at an acute angle to the longitudinal axis of the elongated body, attaching a sensor to the elongated body, and configuring the sensor to sense at least one of stress applied to the elongated body and strain resulting from an applied stress when the cutting element is mounted on an earth-boring tool and used to cut subterranean formation material.

A method of forming a wellbore may comprise rotating an earth-boring tool comprising a cutting element within a wellbore and cutting formation material using the cutting element, and measuring at least one of stress applied to the elongated body and strain resulting from an applied stress as the cutting element is used to cut formation material. The cutting element may comprise a generally planar volume of hard material attached to an elongated body proximate an end of the elongated body, and a sensor affixed to the elongated body. A line normal to the generally planar volume of hard material may be oriented at an acute angle to the longitudinal axis of the elongated body.

BRIEF DESCRIPTION OF THE DRAWINGS

While the specification concludes with claims particularly pointing out and distinctly claiming that which are regarded as embodiments of the present invention, advantages of embodiments of the disclosure may be more readily ascertained from the description of certain example embodiments set forth below, when read in conjunction with the accompanying drawings, in which:

DETAILED DESCRIPTION

The illustrations presented herein are not meant to be actual views of any particular cutting element, earth-boring tool, or portion of such a cutting element or tool, but are merely idealized representations that are employed to describe embodiments of the present disclosure. Additionally, elements common between figures may retain the same numerical designation.

As used herein, an "earth-boring tool" means and includes any type of bit or tool used for drilling during the formation or enlargement of a wellbore in subterranean formations and includes, for example, fixed cutter bits, rotary drill bits, percussion bits, core bits, eccentric bits, bi-center bits, reamers, mills, drag bits, roller cone bits, hybrid bits and other drilling bits and tools known in the art.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "hard material" means and includes any material having a Knoop hardness value of about 3,000 $Kg_f/mm^2$ (29,420 MPa) or more. Hard materials include, for example, diamond and cubic boron nitride.

In some embodiments, the present disclosure includes a cutting element for an earth-boring tool instrumented with a sensor.

Figure 1:
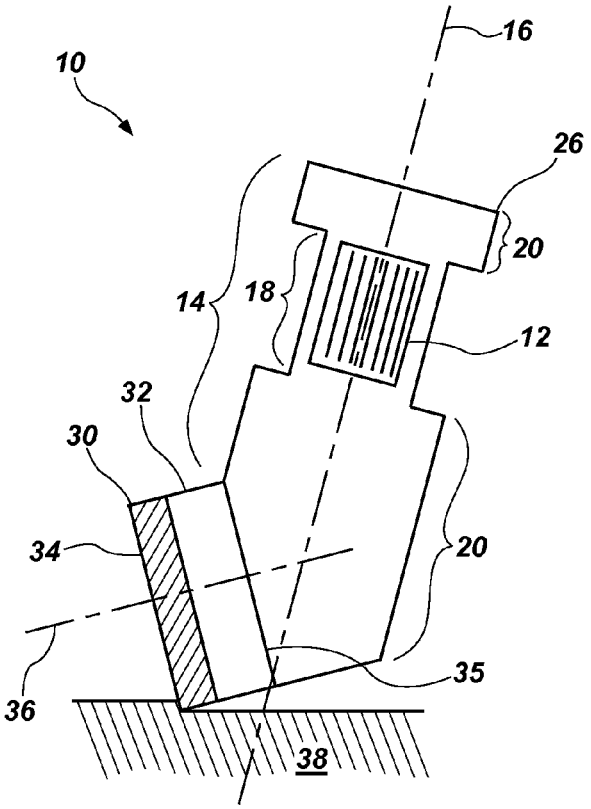
FIGS. 1 through 4 are side elevation views of embodiments of cutting elements of the disclosure.
Figure 2:
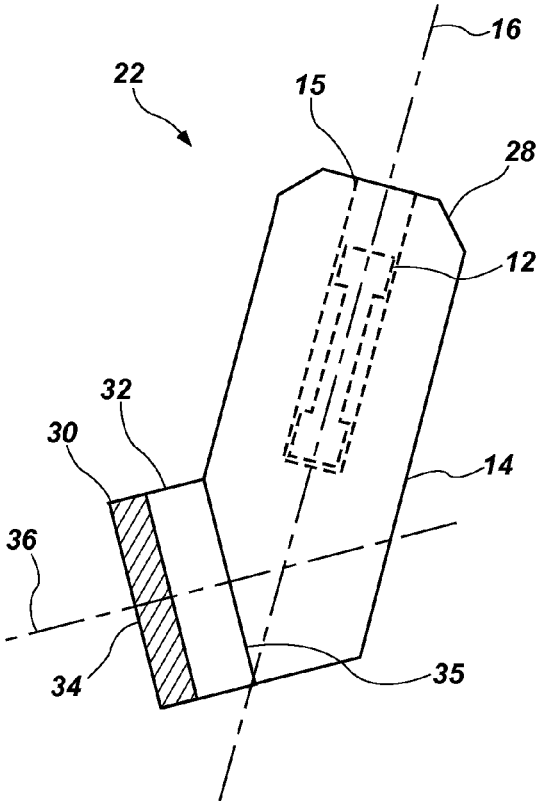
Figure 3:
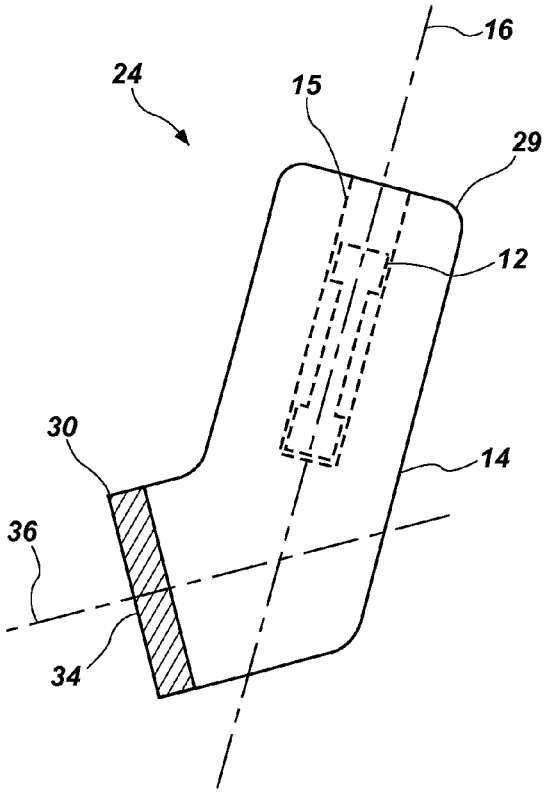

FIG. 1 is a side elevation view of a cutting element 10 with a sensor 12 therein. The cutting element 10 may comprise an elongated body 14 (e.g., a post) having a longitudinal axis 16. The elongated body 14 may have a portion 18 with a smaller lateral dimension than remaining portions 20 of the elongated body 14. The portion 18 may be surrounded by the remaining portions 20. The portion 18 may be described as a recess in the elongated body 14. For example, the elongated body 14 may have a generally cylindrical shape. In such embodiments, the portion 18 may have a smaller diameter than a diameter of the remaining portions 20 of the elongated body 14. In embodiments in which the elongated body 14 has a generally prismatic shape, the portion 18 may have a smaller width than the remaining portions 20 of the elongated body 14. Though the portion 18 is shown as having an approximately uniform lateral dimension, the lateral dimension may vary along the portion 18. Furthermore, the transition between the smaller lateral dimension of the portion 18 and the larger lateral dimension of the portion 20 may be abrupt, as shown in FIG. 1, or gradual. For example, the portion 18 may have a geometry matching a geometry of a tension coupling, gradually transitioning between the diameter of portion 18 to the diameter of portion 20. FIGS. 2 and 3 show other embodiments of cutting elements 22 and 24, respectively. The elongated bodies 14 of cutting elements 22 and 24 may have an approximately uniform lateral dimension. In other words, the elongated bodies 14 of cutting elements 22 and 24 may lack a portion having a smaller lateral dimension than remaining portions.

As shown in FIG. 1, the elongated body 14 may have corners 26 having approximately right angles. In other embodiments, the elongated body 14 may have chamfered edges 28, as shown in FIG. 2, or rounded edges 29, as shown in FIG. 3.

The elongated body 14 may comprise a material such as steel, a carbide, or a mixture thereof. The material of the elongated body 14 may be selected to match, or be similar to material of a body into which the cutting elements 10, 22, or 24 may be installed. Some flexibility of the material of the elongated body 14 may be desirable such that deflections of the elongated body 14 due to applied forces may be measured.

The cutting element 10, 22, or 24 may include a volume of hard material 30 attached to one end of the elongated body 14. The volume of hard material 30 may be generally planar and may include, for example, a polycrystalline material. The volume of hard material 30 may be disposed over a substrate 32, as shown in FIGS. 1 and 2, and the substrate 32 may be attached proximate an end of the elongated body 14. The substrate 32 may be attached to the elongated body 14 by a brazed joint 35. A brazed joint 35 may be formed by heating the substrate 32 and the elongated body 14, and fusing them together with a filler metal, which flows into pores or voids of the substrate 32 and the elongated body 14 as it cools. The cooled filler metal may bond the substrate 32 and the elongated body 14 together. The volume of hard material 30 may have a size and shape such that it does not intersect the longitudinal axis 16.

In some embodiments, as shown in FIG. 3, the volume of hard material 30 may be attached directly to the elongated body 14. Whether attached to a substrate 32 (FIGS. 1 & 2) or to an elongated body 14 (FIG. 3), the volume of hard material 30 may be formed by methods known in the art, which are not detailed herein. The volume of hard material 30 may have an approximately planar surface 34. The volume of hard material 30 may have a line 36 normal to a portion thereof. For example, if the volume of hard material 30 is generally planar, the line 36 may be normal to the volume of hard material 30. The line 36 may be oriented at an acute angle to the longitudinal axis 16 of the elongated body 14. When used in an earth-boring tool, the volume of hard material 30 may contact a portion of a subterranean formation 38.

The elongated body 14 may include one or more sensors 12 attached rigidly thereto. Sensors 12 may be configured to measure, for example, stress applied to the elongated body 12 or strain resulting from application of stress. For example, the sensor 12 is shown as a strain gauge in FIG. 1 and as a load cell (indicated by dashed lines) in FIGS. 2 and 3. The sensor 12 may include, for example, a strain sensor (e.g., a piezoresistive strain gauge), a load cell (i.e., a force transducer), a torque cell, a bending cell, or a thermocouple. For example, in some embodiments, the sensor may include a multi-axis load cell, such as a tri-axial load cell. The sensor 12 may include sensors such as those described in Load Cells for Sensing Weight and Torque on a Drill Bit While Drilling a Well Bore, U.S. Pat. No. 5,386,724, issued Feb. 7, 1995, the disclosure of which is incorporated herein in its entirety by this reference.

In some embodiments, the sensor 12 may be disposed over a surface of the elongated body 14, such as over the portion 18 shown in FIG. 1. In other embodiments, the sensor 12 may be disposed within the elongated body 14, as shown in FIGS. 2 and 3. For example, the elongated body 14 may have a recess 15 formed therein, such as a blind hole in a distal end of the elongated section from the volume of hard material 30. The sensor 12 may be attached to the elongated body 14 by various means, such as by a press-fit or by an adhesive (e.g., epoxy).

Figure 4:
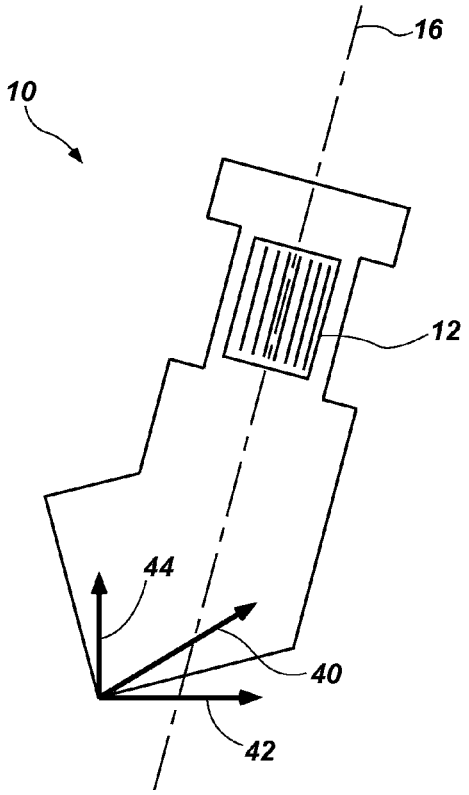

The sensor may have a longitudinal axis corresponding to the longitudinal axis 16 of the elongated body 14. The placement of the sensor 12 may be selected such that the forces acting on the cutting element 10 are not in line with the sensor 12. For example, a force 40 acting on cutting element 10 by a subterranean formation 38 (see FIG. 1) is shown in FIG. 4. The force 40 on the cutting element 10 may comprise a tangential component 42 and a normal component 44. The force 40 may act in a direction forming an acute angle with the longitudinal axis 16 of the elongated body 14 of the cutting element 10. If the sensor 12 is configured to measure force and is located away from the line along which the force 40 acts, data from the sensor 12 may be used to calculate the magnitudes of the tangential component 42 and the normal component 44.

The sensor 12 may be configured to communicate with other portions of a drill string. For example, the sensor 12 may have an electrical connection to a module configured to transmit signals to a computer and/or receive signals from a computer. The sensor 12 may be configured to send and/or receive optical signals, analog electrical signals (e.g., current or voltage), digital signals, or any other signals. In some embodiments, the sensor 12 may be connected by a wire, a fiber-optic cable, etc., to a data acquisition computer system located on or in a shank of the drill bit or in a sub to which the drill bit is secured. The sensor 12 may, in some embodiments, include a wireless communication device to send and/or receive signals to and from the data acquisition module.

Figure 5A:
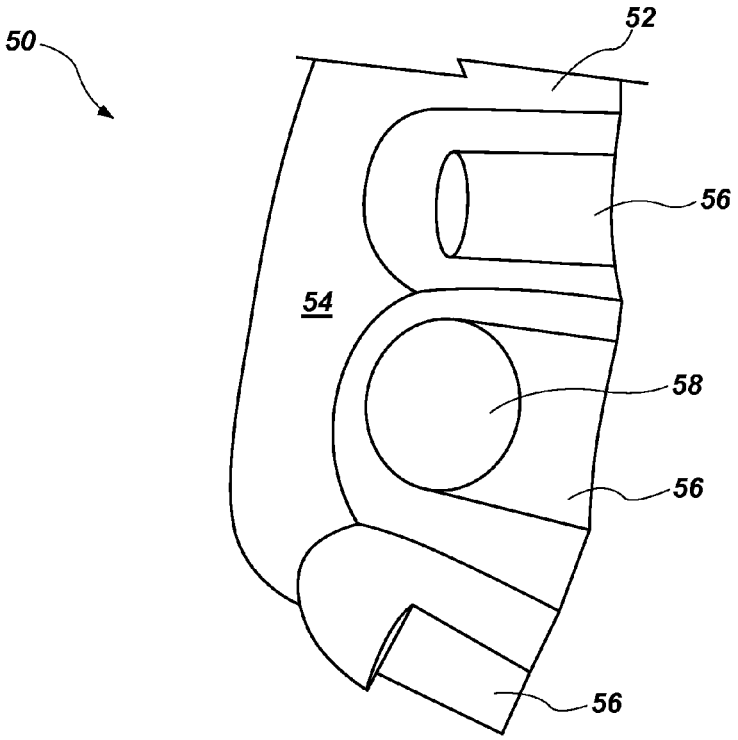
FIGS. 5A through 6B are views of portions of embodiments of earth-boring tools of the disclosure.
Figure 5B:
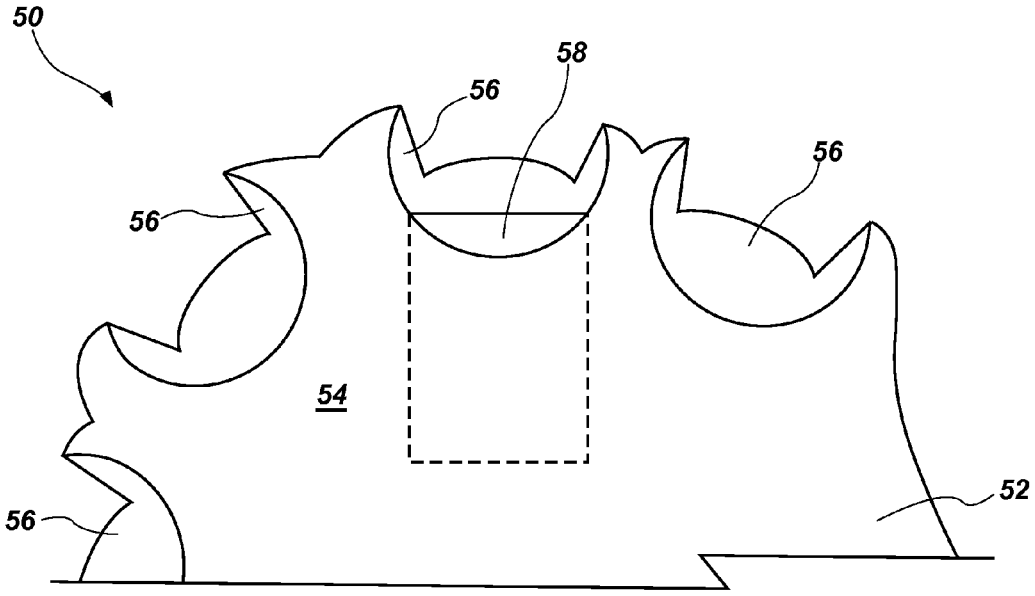

Earth-boring tools may be configured to retain cutting elements 10 instrumented as described above. For example, FIGS. 5A and 5B show portions of an earth-boring tool 50 having a body 52 therein. The earth-boring tool 50 may be any tool known in the art, such as a fixed-cutter rotary drill bit, a roller cone bit, a diamond-impregnated bit, a hybrid bit, etc. The body 52 may include, for example, a blade 54. A pocket 56 or cavity may be formed within the body 52. The pocket 56 may be shaped such that a cutting element 10 may fit therein. The pocket 56 may have a recessed portion 58 (shown partially with dashed lines in FIG. 5B to indicate edges hidden within the body 52) configured to contain the elongated body 14 of the cutting element 10. As shown in FIGS. 5A and 5B, the body 52 may have multiple pockets 56. The pockets 56 may be disposed at an edge of the body 52, such that cutting elements 10 placed within the pockets 56 contact a portion of a subterranean formation when the earth-boring tool 50 is used in a drilling operation.

Figure 6A:
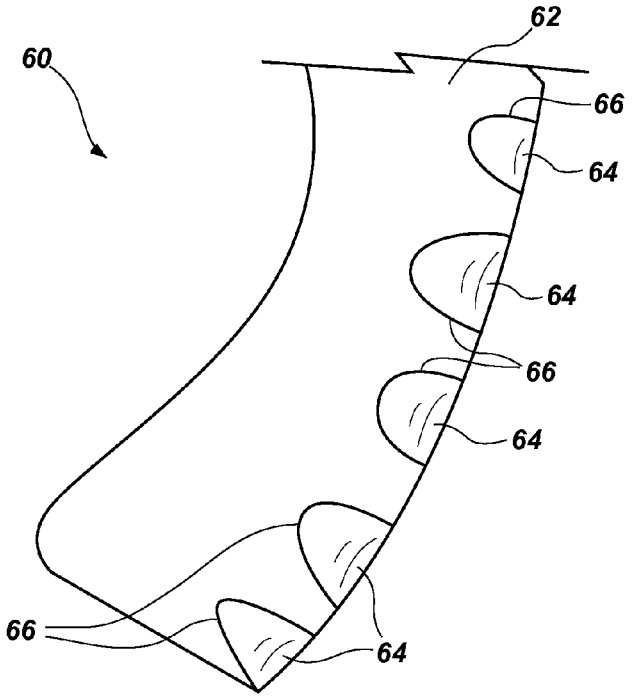
Figure 6B:
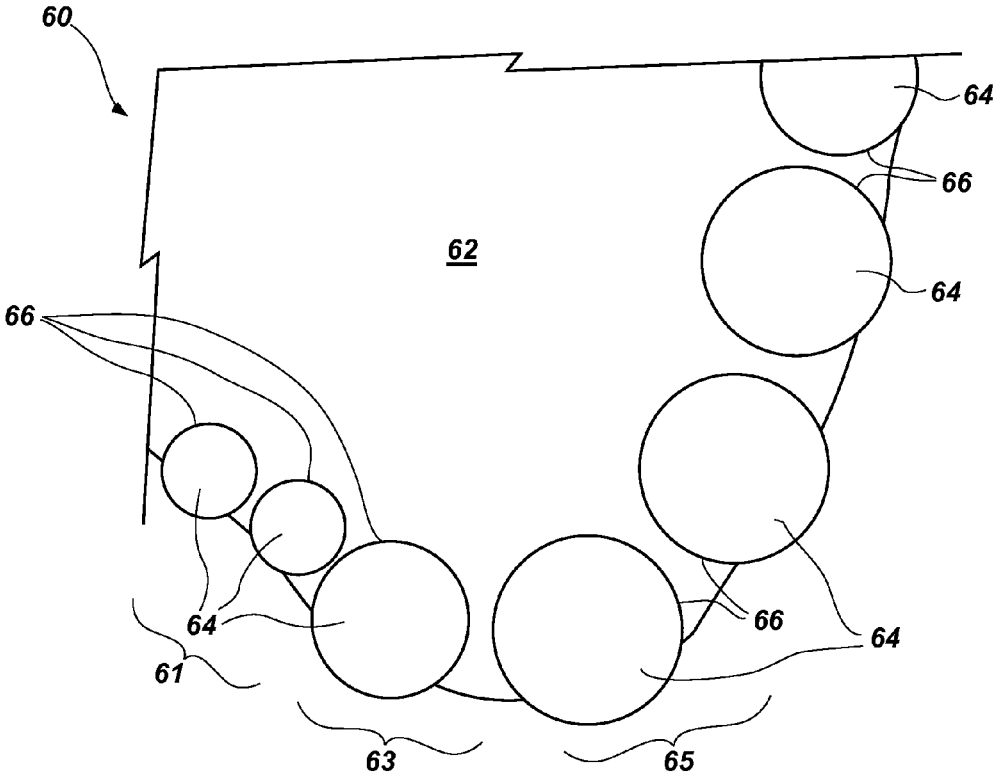

FIGS. 6A and 6B show another embodiment of an earth-boring tool 60 according to the present disclosure. The earth-boring tool 60 may include a body 62 having a cone region 61, a nose region 63, and a shoulder region 65. The body 62 may include pockets 66 within the cone region 61, the nose region 63, and/or the shoulder region 65. The pockets 66 may have cutting elements 64 affixed therein by methods known in the art for securing cutting elements, such as by brazing, cosintering, etc. One or more of the cutting elements 64 may be a cutting element 10, 22, or 24, comprising a sensor 12, as described herein with respect to FIGS. 1 through 4. Sensors 12 may be configured to measure parameters useful in determining properties of the subterranean formation or the earth-boring tool 60. For example, a sensor 12 proximate a cutting element 64 within a cone region 61 may be configured to measure the weight-on-bit (WOB). One or more of the cutting elements 64 may comprise conventional cutting elements without sensors.

Returning to FIG. 1, embodiments of cutting elements of the present disclosure may be formed by providing an elongated body 14, securing a volume of hard material 30 to the elongated body 14, and securing a sensor 12 to the elongated body 14.

The elongated body 14 may be formed by methods known in the art, such as by machining, pressing, casting, etc. The elongated body 14 may be formed of steel, a carbide, a boride, a nitride, an oxide, or a combination of materials. A portion 18 having a smaller lateral dimension than remaining portions 20 may be formed in the elongated body 14, such as by machining or other means. Other features of the elongated body 14, such as corners 26, chamfered edges 28 (FIG. 2), and rounded edges 30 (FIG. 3), may be formed in a similar manner. A cavity 15 (FIGS. 2 and 3) may be formed (e.g., drilled) in the elongated body 14 to have a size and shape to accommodate a sensor 12.

As discussed above in relation to FIGS. 1 through 3, the elongated body 14 may have a longitudinal axis 16. The volume of hard material 30 may be secured proximate an end of the elongated body 14 by any method known in the art, such as by brazing or cosintering. The volume of hard material 30 may optionally be affixed to a substrate 32, which may in turn be affixed to the elongated body 14. The substrate 32 may be affixed to the elongated body 14 by methods known in the art, such as brazing, cosintering, etc.

The sensor 12 may be disposed proximate the elongated body 14. As shown in FIG. 1, the sensor 12 may be affixed over an outside of the elongated body 14, such as to a portion 18 formed therein. In other embodiments, the sensor 12 may be disposed within a cavity 15 in the elongated body 14. The sensor may be affixed to the elongated body 14 by a variety of means, such as by shrink fitting, pressing, applying an adhesive, securing with a fastener (e.g. a screw), etc., or combinations thereof. Installation methods may be selected to avoid exposing the sensor 12 to high temperatures, because high temperatures may damage some sensors 12. After installing the sensor 12, some or all of a remaining portion the cavity 15 may be filled with an adhesive to protect the sensor 12.

Returning to FIGS. 5A through 6B, an earth-boring tool 50, 60 may be formed by providing a body 52, 62 having a pocket 56, 66 formed therein. The pocket 56, 66 may be formed to accommodate a cutting element 64. For example, the pocket 56, 66 may include a recessed portion 58 to accommodate an elongated body 14 of a cutting element 10, 22, or 24, as shown in FIGS. 1 through 3. The body 52, 62 may be provided by methods known in the art, such as by machining, pressing, casting, drilling, etc.

A cutting element 64 may be secured within the pocket 56, 66. The cutting element 64 may include any of the features described above with respect to cutting elements 10, 22, and 24, and may be formed as described above. A sensor 12 may be disposed proximate an elongated body 14 of the cutting element 64, as shown in FIGS. 1 through 3.

The cutting element 64 may be secured within the pocket 56, 66. Since heat may damage some sensors 12, a cutting element 64 having a sensor 12 may be installed in a way that limits the temperature to which the sensor 12 is exposed. For example, the body 52, 62 may be heated, and the unheated cutting element 64 may be press-fit into the pocket 56, 66. The cooling body 52, 62 may shrink around the cutting element 64. As another example, resistive brazing may be used to secure the cutting element 64 within the pocket 56, 66. A thin layer of brazing material may be applied to the cutting element 64, and the cutting element may be inserted into the pocket 56, 66. An electric current may be applied across the brazing material, providing localized heat to melt it. The brazing material may flow into the cutting element 64 and the body 52, 62 and cool, forming a bond. Alternatively, ultrasonic brazing may be used to secure the cutting element 64 within the pocket 56, 66. A thin layer of brazing material may be applied to the cutting element 64, and the cutting element may be inserted into the pocket 56, 66. The brazing material may melt when exposed to vibrations of a certain frequency. Application of that frequency may bond the cutting element 64 within the pocket 56, 66 without damaging the sensor 12.

A communication link may be established between the sensor 12 and a data collection system. For example, a link may be formed between the sensor 12 and a data acquisition computer on a shank of an earth-boring tool, such as by electrical wires, fiber optics, wireless communication, etc. In embodiments in which a physical wire or cable connects the sensor 12 to the data acquisition computer, one or more wire ways may be formed, in which the wires or cables may be disposed. The computer may record data from the sensor 12, transmit data to the sensor 12, control operating parameters, and/or report data to an operator.

In some embodiments, multiple sensors 12 may be installed in a single earth-boring tool 50, 60. For example, multiple cutting elements 10, 22, or 24 having sensors 12 may be installed in an earth-boring tool 50, 60, or multiple sensors 12 may be installed in a single cutting element 10, 22, or 24. Fiber optic signals may be particularly suitable in earth-boring tools 50, 60 having multiple sensors 12 because fiber optic cables may be used to carry signals from multiple sensors 12. Thus, problems associated with large quantities of wiring may be avoided.

A wellbore may be formed by rotating an earth-boring tool 50, 60 having a cutting element 64 with a sensor 12 and by receiving information from the sensor 12. Information (e.g., data from the sensor 12) may be processed, interpreted, or recorded, such as in a data collection computer or a control system. Data from the sensor 12 may be compared to threshold values. For example, a parameter measured by a sensor 12 within or outside a predetermined range may trigger an alert communicated to an operator. The operator may then make appropriate adjustments to operating parameters such as, for example, WOB, rotational speed of the drill string, or both. In some embodiments, a control system (e.g., a computer) may alter an operating parameter based on information from the sensor. A control system may also be used to send signals to the sensor 12, such as signals to begin or to end data collection.

Data from one or more sensors 12 may be used to characterize a hardness of a subterranean formation. Forces 40 (including tangential components 42 and normal components 44) may be compared with WOB data to calculate hardness at a particular location (e.g. depth of formation). Areas of differing hardness may indicate different formations, or different materials within a formation. A drillability index may be assigned to formations and areas of the formation to indicate differences in materials. Information from the sensor 12, in combination with other data regarding depth, direction and inclination of the drill string at the drill bit from which the location of such formations and materials and the location and orientation of boundaries between the formations and materials may be ascertained, may be used to map formation features and to select locations for future wells. Sensors 12 may be calibrated before use (e.g., before insertion in a wellbore) to account for variations in sensor 12 characteristics, variations in characteristics of the cutting elements 10, 22, or 24, and/or variations in orientation and placement of the cutting elements 10, 22, or 24. If the force 40 is measured along the longitudinal axis 16 of the elongated body 14, calibration may be needed to correlate WOB with the force 40 measured. The geometry of the earth-boring tool 50, 60, the cutting element 10, 22, or 24, and the sensor 12 may determine the relationship between WOB and the force 40.

Figure 7:
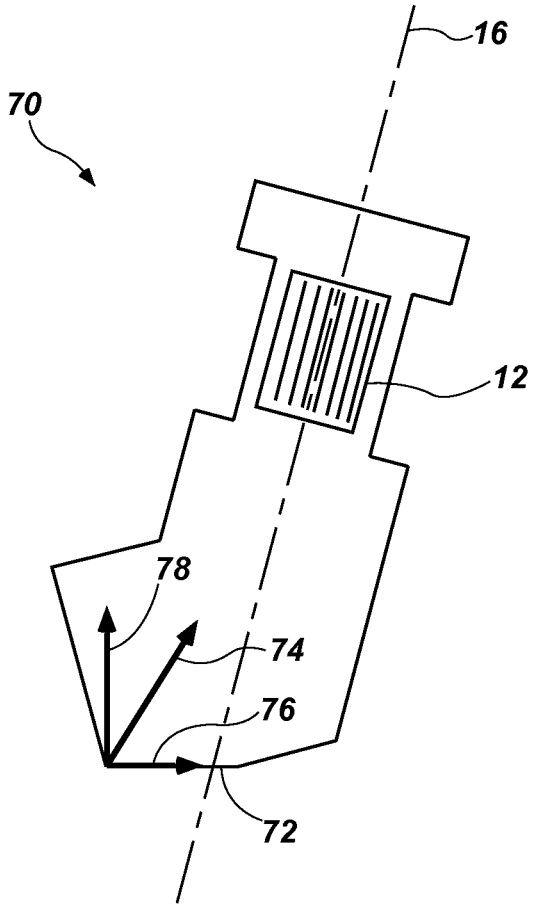
FIG. 7 is a side elevation view of an embodiment of a cutting element of the disclosure.

Data from the sensor 12 may also be used to determine the condition of the earth-boring tool 50, 60. Data obtained during drilling may indicate whether a cutting element 10, 22, or 24 is sharp or dull. For example, FIG. 7 shows a worn cutting element 70, such as a cutting element 10 (FIG. 4) after use in forming a wellbore. During use, a face 72 parallel to a surface of a subterranean formation may form on the cutting element 70. As the face 72 forms, it may increase in surface area, based on the geometry of the cutting element 70. As the face 72 bears on the subterranean formation, the subterranean formation may exert a force 74 on the cutting element 70. The magnitude and/or direction of the force 74 may vary based on the surface area of the face 72. That is, the force 74 may have a tangential component 76 and a normal component 78, and the tangential component 76 and normal component 78 may differ from the tangential component 42 and normal component 44 of the unworn cutting element 10 shown in FIG. 4. The amount of wear on the cutting element 70 may be a function of the ratio of the tangential component 76 to the normal component 78 of the force 74. That is, as the cutting element 70 wears, the ratio of the tangential component 76 to the normal component 78 of the force 74 may decrease. A computer or operator may be alerted to the wear condition of the cutting element 70 (e.g., when a selected ratio of tangential component 76 to the normal component 78 of the force 74 is observed), and the earth-boring tool 50, 60 may be removed from the wellbore before catastrophic failure of the cutting element 70.

Data from the sensor 12 may be used for development of cutter technology. For example, information about subterranean cutter loads may be used to evaluate different materials and/or cutter geometries (e.g., shape, chamfer, side rake angle, back rake angle, etc.). Furthermore, data may assist an operator in selecting appropriate tools for similar wells or in determining whether a particular tool is fit for service.

Cutting elements 10, 22, or 24 in the cone region 61 may be less likely to be damaged while drilling. Therefore, cutting elements 10, 22, or 24 disposed in the cone region 61 may provide data useful for calculating formation hardness. Data from such cutting elements 10, 22, or 24 may also be used as references to compare with data from cutting elements 10, 22, or 24 within the nose region 63 and/or the shoulder region 65. As one or more cutting elements 10, 22, or 24 reaches a wear threshold, a computer or control system may alert an operator. The operator may cease further drilling, and may remove the earth-boring tool 50, 60 from the wellbore to replace the cutting elements 10, 22, or 24. The wear threshold may be calibrated before the earth-boring tool 50, 60 is used. By replacing the cutting elements 10, 22, or 24 when they are worn, the risk of breakage downhole (where removal can be more expensive and time-consuming) may be decreased. Yet the earth-boring tool may be kept in service longer if wear remains below a selected level as determined from data measured by the sensor 12.

In additional embodiments, a cutting element 10, 22, or 24 may include multiple sensors 12, such as one or more of a strain sensor, a load cell, a torque cell, a bending cell, an accelerometer, a thermocouple, etc. The cutting element 10, 22, or 24 may also include additional components configured for use with sensors 12, such as signal conditioning electronics, wireless transceiver electronics, power supplies, etc. A cutting element 10, 22, or 24 having such sensors 12 and/or additional components may be called "smart sensors."

Additional non-limiting example embodiments of the disclosure are described below.

Embodiment 1

A cutting element for an earth-boring tool comprising an elongated body having a longitudinal axis, a generally planar volume of hard material attached to the elongated body, and a sensor affixed to the elongated body. A line normal to the generally planar volume of hard material is oriented at an acute angle to the longitudinal axis of the elongated body. The sensor is configured to sense at least one of stress applied to the elongated body and strain resulting from an applied stress when the cutting element is mounted on an earth-boring tool and used to cut subterranean formation material.

Embodiment 2

The cutting element of Embodiment 1, wherein the volume of hard material is brazed directly to the elongated body.

Embodiment 3

The cutting element of Embodiment 1 or Embodiment 2, wherein the sensor comprises at least one of a strain gauge, a load cell, a torque cell, and a bending cell.

Embodiment 4

The cutting element of any of Embodiments 1 through 3, wherein the sensor comprises a tri-axial load cell.

Embodiment 5

The cutting element of any of Embodiments 1 through 4, wherein the volume of hard material is bonded to a substrate and the substrate is attached to the elongated body by a brazed joint.

Embodiment 6

The cutting element of Embodiment 5, wherein the substrate comprises a hard material selected from the group consisting of carbides, borides, nitrides, oxides, and mixtures thereof.

Embodiment 7

The cutting element of any of Embodiments 1 through 6, wherein the elongated body comprises a first portion having a first lateral dimension measured along a plane perpendicular to the longitudinal axis and a second portion having a second lateral dimension measured along a plane perpendicular to the longitudinal axis different from the first lateral dimension.

Embodiment 8

The cutting element of any of Embodiments 1 through 7, wherein the elongated body comprises a material selected from the group consisting of steel, carbides, and mixtures thereof.

Embodiment 9

The cutting element of any of Embodiments 1 through 8, wherein the volume of hard material does not intersect the longitudinal axis of the elongated body.

Embodiment 10

An earth-boring tool, comprising a body comprising a pocket and a cutting element disposed at least partially within the pocket. The cutting element comprises an elongated body having a longitudinal axis, a generally planar volume of hard material attached to the elongated body proximate an end of the elongated body, and a sensor affixed to the elongated body. A line normal to the generally planar volume of hard material is oriented at an acute angle to the longitudinal axis of the elongated body. The sensor is affixed to the elongated body and configured to sense at least one of stress applied to the elongated body and strain resulting from an applied stress when the generally planar volume of hard material is used to cut subterranean formation material during use of the earth-boring tool.

Embodiment 11

The earth-boring tool of Embodiment 10, wherein the cutting element comprises a brazed joint between the volume of hard material and the elongated body.

Embodiment 12

The earth-boring tool of Embodiment 10 or Embodiment 11, wherein the sensor comprises at least one of a strain gauge, a load cell, a torque cell, and a bending cell.

Embodiment 13

The earth-boring tool of any of Embodiments 10 through 12, wherein the volume of hard material is disposed over a substrate. The substrate is attached to the elongated body by a brazed joint and comprises a hard material selected from the group consisting of carbides, borides, nitrides, oxides, and mixtures thereof.

Embodiment 14

The earth-boring tool of any of Embodiments 10 through 13, wherein the elongated body comprises a first portion having a first lateral dimension and a second portion having a second lateral dimension different from the first lateral dimension.

Embodiment 15

The earth-boring tool of any of Embodiments 10 through 14, further comprising a module configured to transmit data between the sensor and a data collection system.

Embodiment 16

The earth-boring tool of any of Embodiments 10 through 15, wherein the cutting element is affixed within the pocket by a brazed joint or a press-fit joint.

Embodiment 17

A method of forming a cutting element for an earth-boring tool, comprising securing a generally planar volume of hard material to an elongated body such that the generally planar volume of hard material is disposed in a plane oriented at an acute angle to a longitudinal axis of the elongated body, attaching a sensor to the elongated body, and configuring the sensor to sense at least one of stress applied to the elongated body and strain resulting from an applied stress when the cutting element is mounted on an earth-boring tool and used to cut subterranean formation material.

Embodiment 18

The method of Embodiment 17, wherein securing a volume of generally planar hard material to the elongated body comprises forming the volume of hard material on the elongated body.

Embodiment 19

The method of Embodiment 17 or Embodiment 18, wherein attaching the sensor to the elongated body comprises forming a recess within the elongated body and disposing the sensor within the recess.

Embodiment 20

The method of any of Embodiments 17 through 19, further comprising reducing a lateral dimension of a section of the elongated body.

Embodiment 21

The method of Embodiment 20, wherein attaching the sensor to the elongated body comprises attaching the sensor around the section of the elongated body having the reduced lateral dimension.

Embodiment 22

The method of any of Embodiments 17 through 21, wherein securing the volume of hard material to the elongated body comprises securing a substrate to the elongated body, the volume of hard material disposed over the substrate.

Embodiment 23

A method of forming an earth-boring tool, comprising forming a cutting element and securing the cutting element within a recess in a body of an earth-boring tool. Forming the cutting element comprises securing a generally planar volume of hard material to an elongated body such that the generally planar volume of hard material is disposed in a plane oriented at an acute angle to the longitudinal axis of the elongated body, attaching a sensor to the elongated body, and configuring the sensor to sense at least one of stress applied to the elongated body and strain resulting from an applied stress when the cutting element is mounted on an earth-boring tool and used to cut subterranean formation material.

Embodiment 24

The method of Embodiment 23, further comprising forming the volume of hard material on the elongated body.

Embodiment 25

The method of Embodiment 23 or Embodiment 24, further comprising forming a communication link between the sensor and a data collection system.

Embodiment 26

The method of any of Embodiments 23 through 25, wherein securing a cutting element within the recess comprises heating the body and pressing the cutting element within the recess.

Embodiment 27

The method of any of Embodiments 23 through 26, wherein securing a cutting element within the recess comprises forming a brazing material over at least a portion of the cutting element, disposing the cutting element within the recess, and providing localized heat to the brazing material.

Embodiment 28

A method of forming a wellbore, comprising rotating an earth-boring tool comprising a cutting element within a wellbore, cutting formation material using the cutting element, and measuring at least one of stress applied to the elongated body and strain resulting from and applied stress as the cutting element is used to cut formation material. The cutting element comprises a generally planar volume of hard material attached to an elongated body proximate an end of the elongated body, and a sensor affixed to the elongated body. A line normal to the generally planar volume of hard material is oriented at an acute angle to the longitudinal axis of the elongated body.

Embodiment 29

The method of Embodiment 28, further comprising recording information received from the sensor.

Embodiment 30

The method of Embodiment 28 or Embodiment 29, further comprising comparing data measured by the sensor to at least one of a threshold value and a value measured by a sensor affixed to another cutting element.

Embodiment 31

The method of any of Embodiments 28 through 30, further comprising alerting an operator to a condition based on data obtained from the sensor.

Embodiment 32

The method of any of Embodiments 28 through 31, further comprising altering an operating parameter based on data obtained from the sensor.

Embodiment 33

The method of any of Embodiments 28 through 32, further comprising characterizing a hardness of a subterranean formation using data obtained from the sensor.

While the present disclosure has been set forth herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventors.

What is claimed is:

1. A cutting element for an earth-boring tool, comprising:
a body having a longitudinal axis;
a volume of hard material carried by the body, wherein a line normal to a cutting surface of the volume of hard material is oriented at an acute angle to the longitudinal axis of the body; and
a sensor carried by the body and configured to sense at least one property of the body selected from the group consisting of a strain, a load, a torque, and a bending moment.

2. The cutting element of claim 1, wherein the volume of hard material is brazed to the body.

3. The cutting element of claim 1, further comprising an adhesive affixing the sensor to the body.

4. The cutting element of claim 1, wherein the sensor comprises a tri-axial load cell.

5. The cutting element of claim 1, wherein the volume of hard material is bonded to a substrate and the substrate is attached to the body.

6. The cutting element of claim 1, wherein the body comprises a first portion having a first lateral dimension measured along a plane perpendicular to the longitudinal axis and a second portion having a second lateral dimension measured along a plane perpendicular to the longitudinal axis different from the first lateral dimension.

7. The cutting element of claim 1, wherein the volume of hard material does not intersect the longitudinal axis of the body.

8. The cutting element of claim 1, wherein the sensor is disposed within a blind hole in the body.

9. The cutting element of claim 1, wherein the sensor is disposed over an outer surface of the body.

10. An earth-boring tool, comprising:
a body comprising a pocket; and
a cutting element disposed at least partially within the pocket, the cutting element comprising:
a body having a longitudinal axis;
a volume of hard material carried by the body, wherein a line normal to a cutting surface of the volume of hard material is oriented at an acute angle to the longitudinal axis of the body; and
a sensor carried by the body and configured to sense at least one property of the body selected from the group consisting of a strain, a load, a torque, and a bending moment.

11. The earth-boring tool of claim 10, further comprising a data acquisition system on or in a shank of the earth-boring tool.

12. The earth-boring tool of claim 11, further comprising an electrical connection between the sensor and the data acquisition system.

13. The earth-boring tool of claim 11, further comprising a wireless communication device configured to transfer signals between the sensor and the data acquisition system.

14. The earth-boring tool of claim 10, wherein the pocket is disposed within a cone region of the earth-boring tool.

15. A method, comprising:
securing a volume of hard material to a body to form a cutting element such that a line normal to a cutting surface of the volume of hard material is oriented at an acute angle to a longitudinal axis of the body; and
securing a sensor to the body, the sensor configured to sense at least one property of the body when the cutting element is mounted on an earth-boring tool and used to cut subterranean formation material, the at least one property of the body selected from the group consisting of a strain, a load, a torque, and a bending moment.

16. The method of claim 15, wherein securing the sensor to the body comprises forming a recess within the body and disposing the sensor within the recess.

17. The method of claim 15, further comprising reducing a lateral dimension of a section of the body.

18. The method of claim 17, wherein securing the sensor to the body comprises attaching the sensor around the section of the body having the reduced lateral dimension.

19. The method of claim 15, further comprising securing the cutting element within a recess in a body of an earth-boring tool such that volume of hard material is exposed to the subterranean formation material when the earth-boring tool is used to cut the subterranean formation material.

20. The method of claim 15, further comprising forming a blind hole in the body, securing the sensor to the body comprises disposing the sensor within the blind hole.

* * * * *